United States Patent [19]

Mayerjak

[11] 4,354,704

[45] Oct. 19, 1982

[54] SLING AND METHOD FOR MAKING SAME

[75] Inventor: Robert J. Mayerjak, Torrington, Conn.

[73] Assignee: Kaman Aerospace Corporation, Bloomfield, Conn.

[21] Appl. No.: 192,863

[22] Filed: Oct. 1, 1980

[51] Int. Cl.[3] ..... B66C 1/12

[52] U.S. Cl. ..... 294/74

[58] Field of Search ..... 294/74, 75, 77; 87/6, 87/7, 8; 57/149, 142, 146, 147, 159

[56] References Cited

U.S. PATENT DOCUMENTS

| | | | |
|---|---|---|---|
| 2,299,568 | 10/1942 | Dickey | 294/74 |
| 2,304,306 | 12/1942 | Hobbs, Jr. | 294/74 |
| 2,426,538 | 8/1947 | Von Wehrden | 294/74 |

*Primary Examiner*—James B. Marbert

*Attorney, Agent, or Firm*—McCormick, Paulding & Huber

[57] ABSTRACT

A flexible tension member, or sling, useful as a line to hoist, lower or suspend something or as a tension loaded part of a structure or device has eyes at both of its ends for attachment to other parts or loads. The sling is comprised of a plurality of strands of cord extending between its opposite ends and twisted to form two side-by-side ropes of opposite twist direction. The various cord strands may be part of a single endless cord and the eyes at the opposite ends of the sling may have end fittings with thimbles for efficiently transferring loads from the cord strands to the end fittings.

28 Claims, 22 Drawing Figures

SLING AND METHOD FOR MAKING SAME

BACKGROUND OF THE INVENTION

This invention relates to a flexible tension member, or sling, having eyes or the like at its opposite ends for attachment to associated parts or loads, and deals more particularly with improvements in the construction of such a sling and in the method for making it.

Ropes, cables and similar tension elements are of ancient origin and are commonly used for hoisting, lowering or suspending loads or as tension bearing parts of various structures or devices. One problem inherent in such members is that of how to attach their ends to the parts or loads with which they are used. A common solution is to provide both ends of a member with eyes, and the eyes may be equipped in turn with end fittings of various different shapes and materials for facilitating the connection of the member to other parts or loads. Such a two-eyed flexible tension member is often referred to as a "sling" and such term is used herein with that meaning.

In prior sling constructions the eyes at the opposite ends of the sling have been made by splicing or other methods which are difficult to perform and which often result in weakened or failure-prone areas. Also, particularly in cases where the sling is used as a construction member, it is often desirable that its length between its two eyes be of a prescribed value within narrow limits, and such accuracy of length is often difficult to obtain with present methods of making slings.

The general object of this invention is, therefore, to provide an improved sling which is easily and readily manufactured at relatively low cost by a simple manufacturing method.

A further object of the invention is to provide a sling of the foregoing character constructed in such a manner that the various strands making up the member bear substantially equal loads throughout the length of the member including the area in the vicinity of the eyes.

A still further object of the invention is to provide a sling, and related method of manufacture, of the foregoing character whereby a sling may be readily made to have a finished length matching very accurately a prescribed desired length for the sling.

A still further object of the invention is to provide a sling of the foregoing character which may be made to have lightweight and high strength properties particularly well adapting it for use as a tension link in aircraft structural applications and the like.

Further objects and advantages of the invention will be apparent from the following detailed description of the preferred embodiments and from the drawings accompanying that description.

Prior art patents which disclose slings or the like material to the present disclosure are U.S. Pat. Nos. 2,082,828, 2,142,642, 2,325,261, 3,181,907, 3,222,858, 3,899,206 and 4,043,581.

SUMMARY OF THE INVENTION

This invention resides in a sling comprised of a cord means extending between two ends so as to provide a plurality of bends at each end and a plurality of strands each extending from one end to the other. Half of the strands of the cord means are twisted in one direction to form one rope and the other half of the strands are twisted together in the opposite direction to form a second rope. The bends at one end are positioned side-by-side adjacent one another to form a first eye at that end and the bends at the other end are positioned side-by-side adjacent one another to form a second eye at that end. The two eyes may be fitted with end fittings with each end fitting including a plurality of side-by-side thimbles each receiving a separate one of the associated bends.

The invention also resides in the cord means consisting of a single endless cord, in a wrap surrounding the two ropes to hold them in side-by-side relationship, in the end fittings being potted in a body of potting material and in the cord means being made of kevlar.

The invention also resides in a method for making a sling whereby a cord means is arranged to provide an elongated configuration having a plurality of bends at each end and a plurality of strands each extending between the two ends. The method further includes the steps of dividing the strands of such configuration into two groups and twisting the two groups in opposite directions to form two ropes which are positioned side-by-side one another in the finished sling.

In its method aspects, the invention further resides in applying a wrap around the two ropes to hold them in side-by-side relationship, in providing the cord means in the form of a single endless strand, in fitting thimbled end fittings to the cord bends at the opposite ends of the sling and in potting the end portions in a body of potting material.

DETAILED DESCRIPTION OF THE PREFERRED EMBODIMENTS

Figure 1:
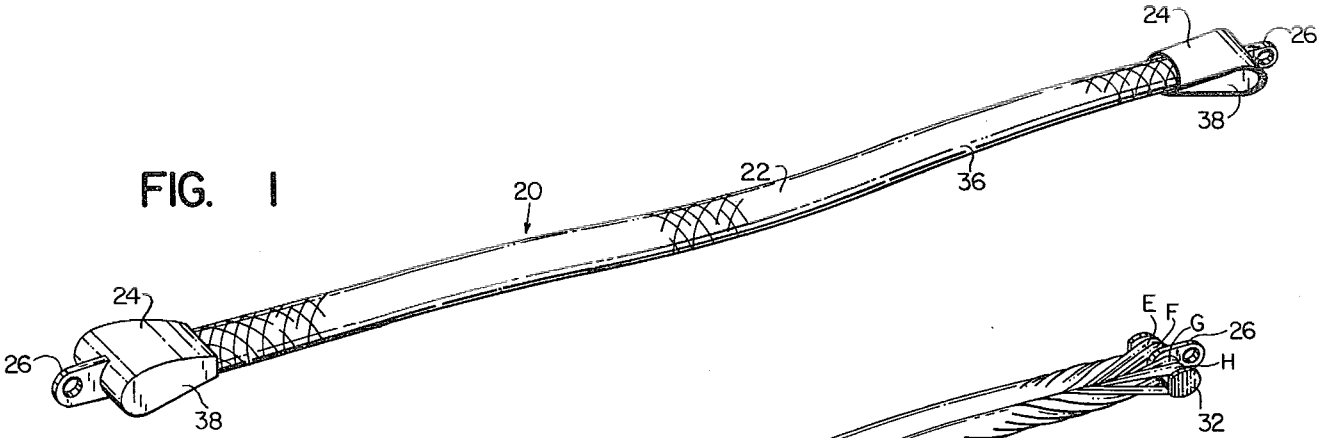
FIG. 1 is a perspective view of a sling embodying the present invention.
Figure 2:
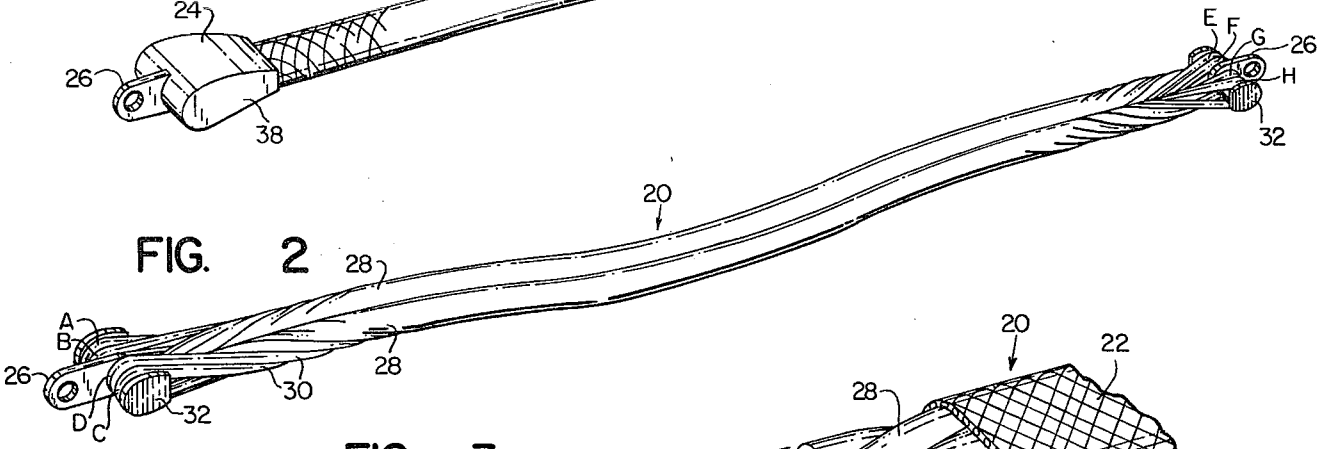
FIG. 2 is a view similar to FIG. 1 but with the wrap and potting material removed to show the sling's inner construction.
Figure 3:
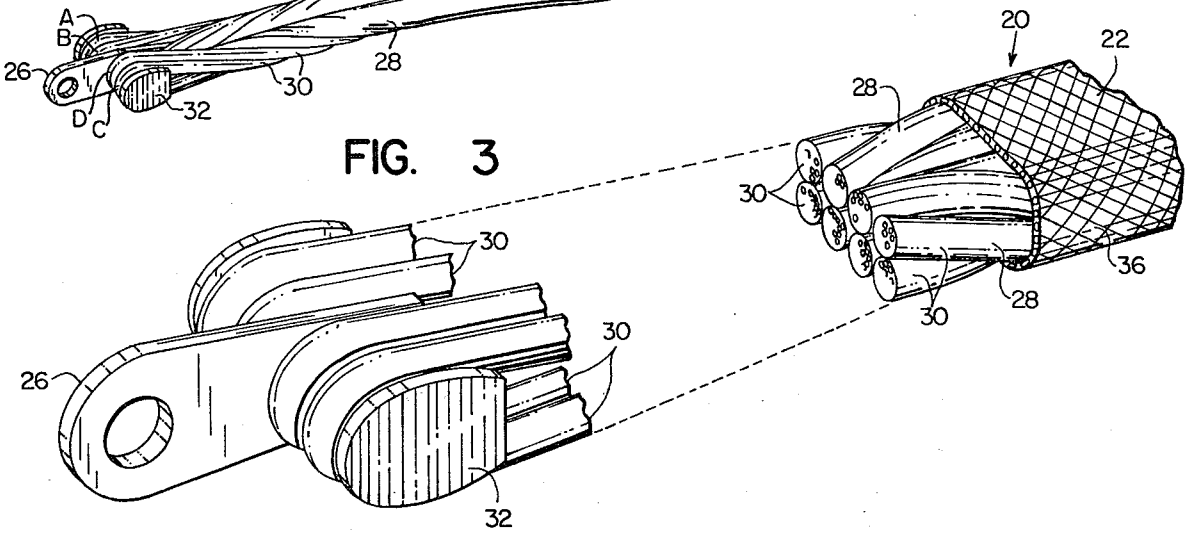
FIG. 3 is an enlarged view of the left-hand end of the sling of FIG. 1 with various parts being shown broken away to reveal the structure of other parts.

Turning first to FIGS. 1 to 4, a sling embodying the present invention, and indicated generally at 20, includes an elongated flexible main portion 22 and two end portions 24, 24 each having a connection means in the form of an apertured ear 26 for use in connecting it to some other part or load. The main part 22 is comprised of two side-by-side ropes 28, 28 each comprised of four strands 30, 30 of twisted cord with the twist of the two ropes being of opposite hand or direction. At the left-hand end of the sling the cord strands 30, 30 are connected by four bends A, B, C and D and at the left-hand end they as connected by four more bends E, F G and H.

The bends of the cord at each end of the sling are positioned side-by-side adjacent one another and provide an eye for that end of the sling. In keeping with the invention, such eye may either be used as is or may be equipped with an end fitting. Such end fitting may vary in shape and have different types of attachment means to suit the parts with which the sling is used. An example of such end fitting, preferably made of metal, is shown at 32.

Figure 4:
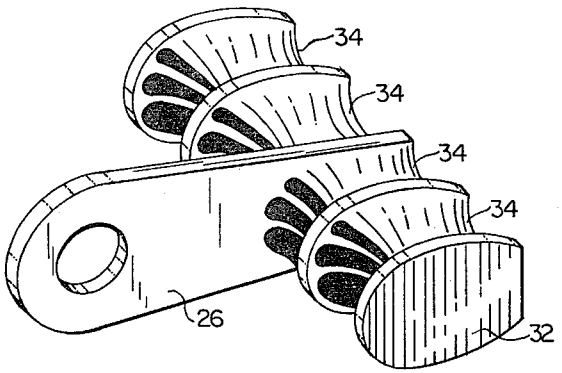
FIG. 4 is a perspective view of one of the end fittings of the sling of FIG. 1.

As shown best in FIG. 4, each fitting 32, in addition to the apertured ear 26 has four thimbles 34, 34 located side-by-side along a line generally perpendicular to the axes of the ropes 28, 28, the ear 26 being located with two thimbles on one side of it and two thimbles on the other side of it and projecting outwardly away from the associated ropes 28, 28. The thimbles 34, 34 of each fitting respectively receive the four associated cord bends A, B, C and D or E, F, G, and H and they are preferably grooved to conform to the generally circular cross section of the cord thereby providing, for each bend, a large contact area between the end fitting and the cord to transfer loads between the end fitting and the bend without stress concentration. Also, it will be noted that in this arrangement the end fitting 32 may be made relatively small and light weight since each cord bend goes around its own thimble which may be of a relatively small diameter. In comparison, if the cord bends were somehow twisted or braided to form an eye, such eye would require a thimble of much larger size and mass. In cases, such as aircraft applications, where weight of the sling is important, the end fittings are preferably made of aluminum, titanium or other light-weight, high strength material and the cord used for the strands 30, 30 of the main portion of the sling is preferably made of kevlar which also has light-weight, high strength properties.

The illustrated sling 20 of FIGS. 1 to 4 also includes a wrap 36 which surrounds the two ropes 28, 28 to hold them in side-by-side relationship. This wrap may be formed in various different ways and, as indicated in more detail hereinafter, may consist of a plurality of threads woven together and in place over the ropes 28, 28 to form the wrap. Also, the sling, at each of its ends, is preferably provided with a body 38 of potting material which surrounds substantially all of the associated fitting 32, except for the protruding ear 26, and the immediately adjacent portions of the two ropes 28, 28 and the wrap 36. Each body 38 of potting material therefore gives the associated end of the sling a neat appearance and maintains the desired relationship between the cord strands and bends, the wrap and the associated end fitting. It further, together with the wrap 36, protects the cord strands from ultra-violet rays of the sun and other environmental conditions which might otherwise have a longterm detrimental effect on the properties of the cord material.

The main body 22 of the sling 20 may be made of two or more endless cords, but preferably, and as shown, it is made of a single endless cord. The making of a sling from a single endless cord, in keeping with the method aspects of the invention, is shown by FIGS. 5 to 17.

Figure 5:
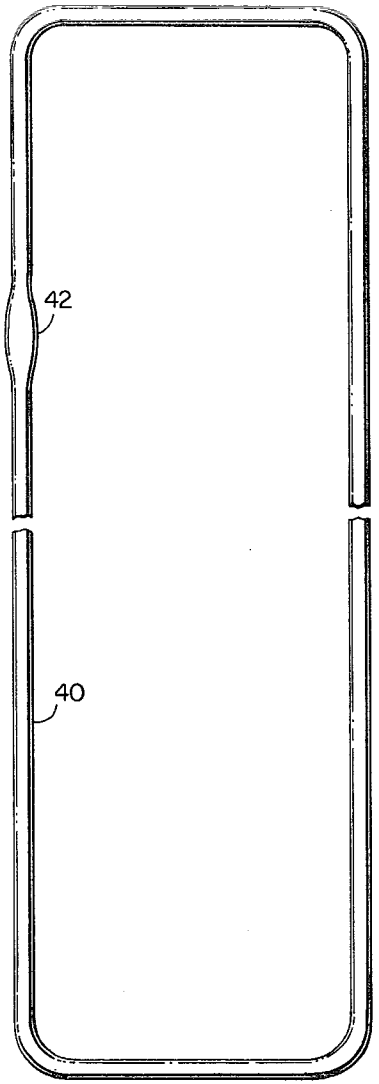

Referring to these figures, a single endless cord 40 is first provided and may, for example, be obtained by joining together the opposite ends of a length of cord by a splice such as indicated at 42 in FIG. 5. Such endless cord 40 is then folded or doubled upon itself to form an elongated configuration having four bends at each end and eight strands extending between the ends. Such configuration may be obtained in various different ways, one of which is exemplified by FIGS. 6 to 13.

Figure 6:
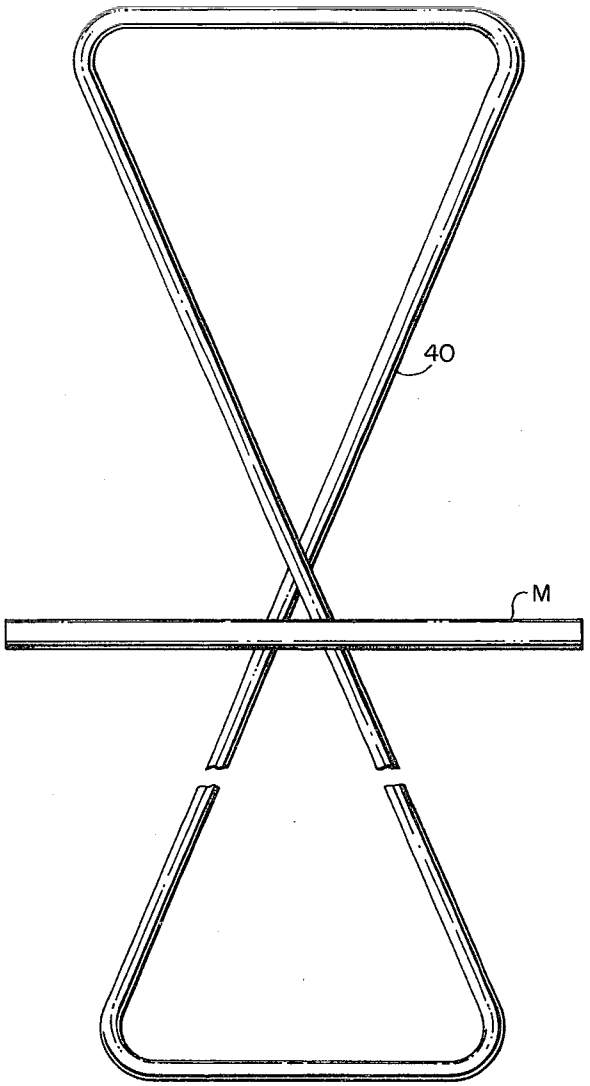
FIGS. 5 to 17 show, somewhat schematically, in sequence the various steps in the manufacture of the sling of FIG. 1.
Figure 8:
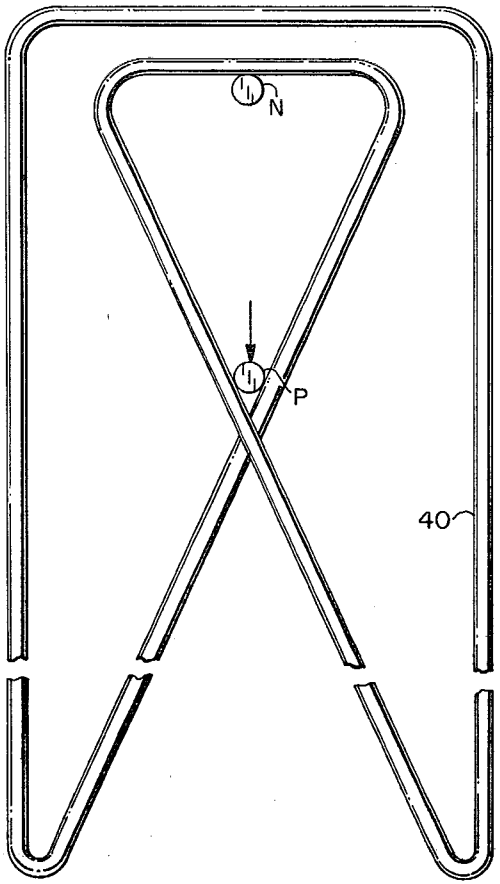
Figure 7:
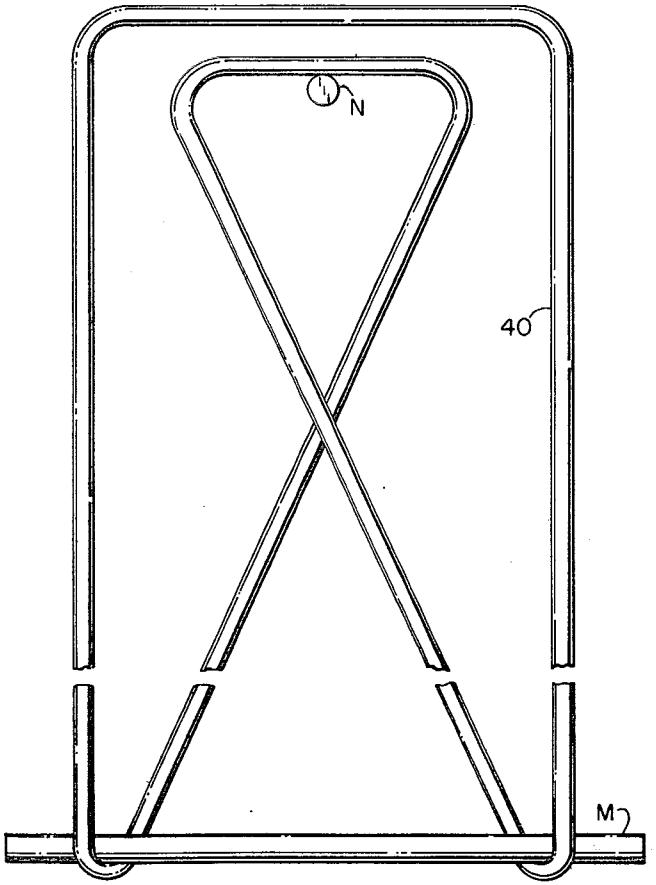

In going from the condition of FIG. 5 to that of FIG. 6 the bottom of the loop shown in FIG. 5 is twisted 180° relative to the top of the loop to form the figure-8 shape of FIG. 6. This figure-8 shape is then folded upon itself, as by folding over the bar M of FIG. 6, to bring the cord into the condition shown in FIG. 7. A bar N is then inserted through the two upper loops of the FIG. 7 configuration, the bar M is removed, and another bar P is inserted immediately below the bar N and pushed downwardly as shown in FIG. 8, thereby bringing the cord to the condition shown in FIG. 9.

Figure 9:
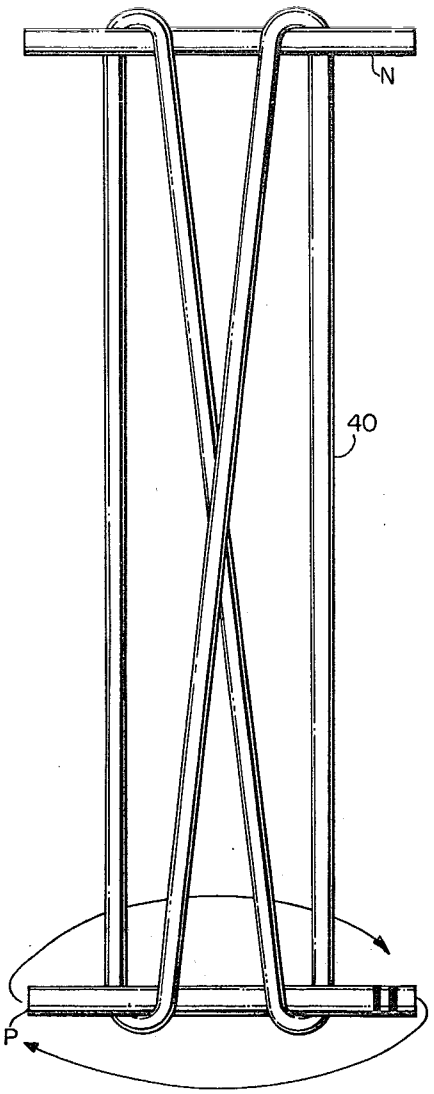
Figure 10:
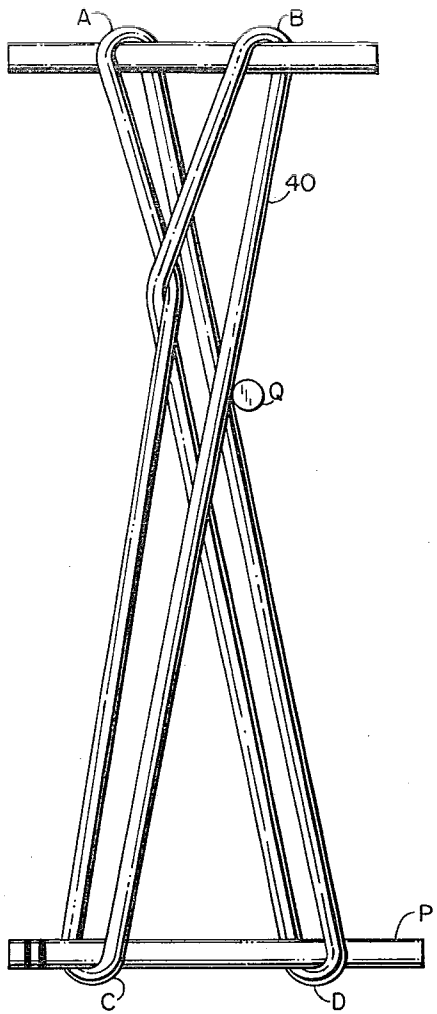
Figure 19:
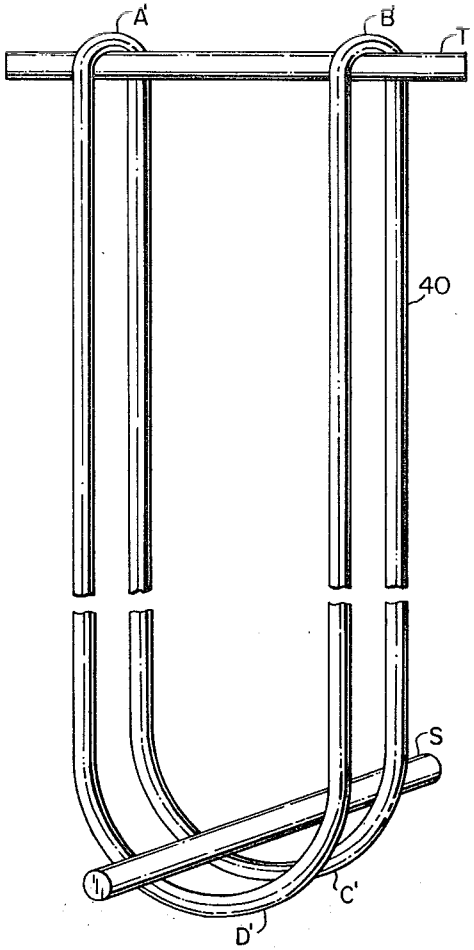
FIGS. 18 to 21 show, somewhat schematically, in sequence various steps in the manufacture of a sling similar to that of FIG. 1 but comprising an alternative embodiment of the invention.

From the FIG. 9 condition of the cord 40, the now lower bar P is rotated 180°, as shown by the arrow of FIG. 9, to bring the cord to the condition shown in FIG. 10. In its FIG. 10 condition, the cord 40 has two upper bends A and B and two lower bends C and D.

Figure 11:
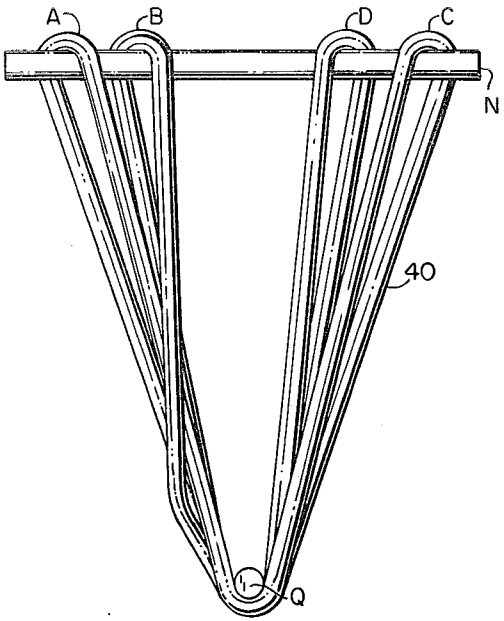

From the FIG. 10 condition, the cord is folded about a bar Q by first bringing the bend D onto the upper bar N and by thereafter bringing the bend C onto the upper bar N to reach the condition of FIG. 11.

Figure 12:
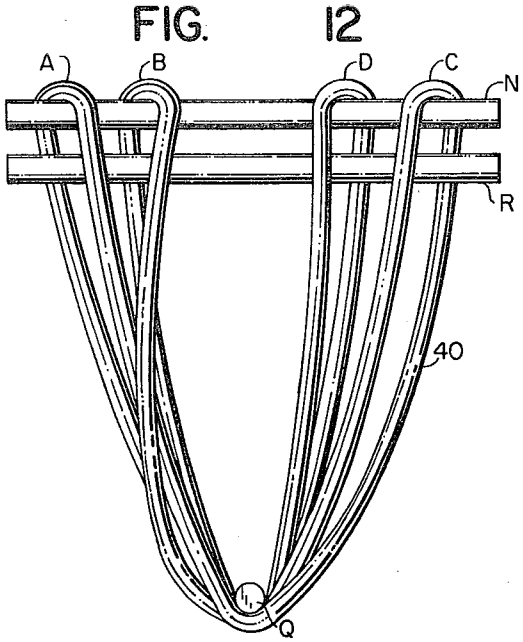

With the cord 40 in the FIG. 11 position a bar R is inserted through the bends A, B, D, and C parallel to and immediately below the bar N as shown in FIG. 12. The bar Q is then withdrawn and the bar R moved downwardly to bring the cord to the condition shown in FIG. 13. The cord configuration of FIG. 30 is the desired pre-twist configuration having four bends A, B, D and C at one end, four bends E, F, G and H at the other end and eight strands 30, 30 extending between the bends.

Figure 13:
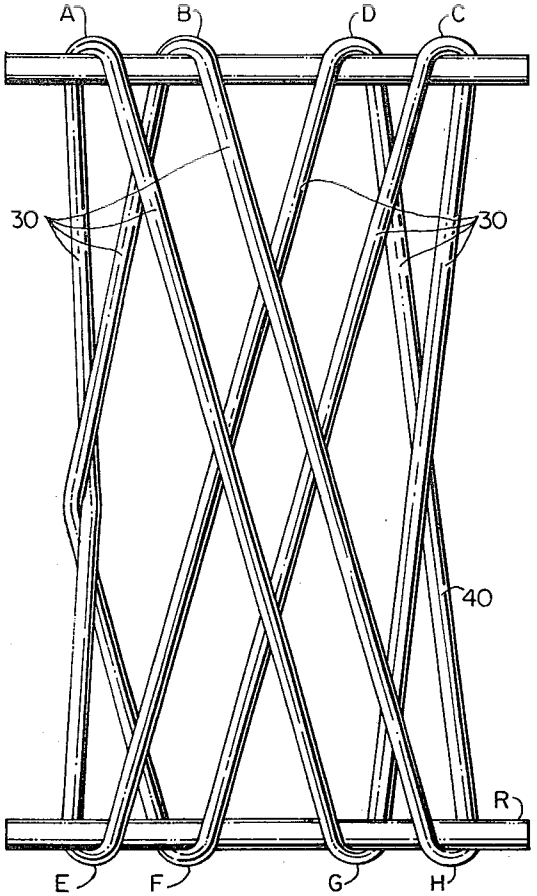
Figure 14:
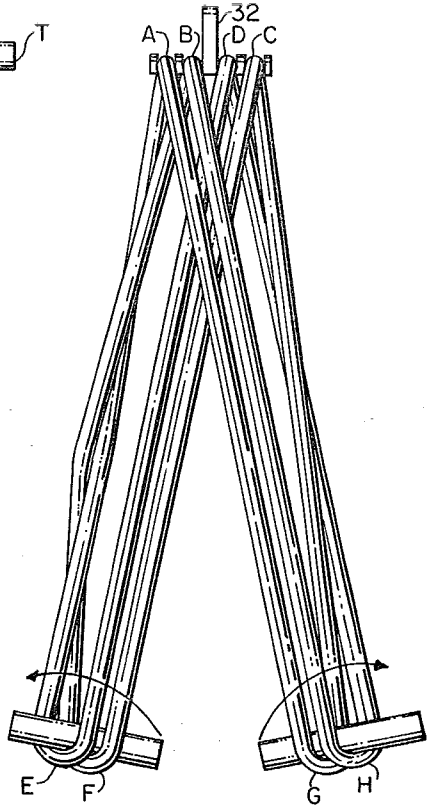
Figure 21:
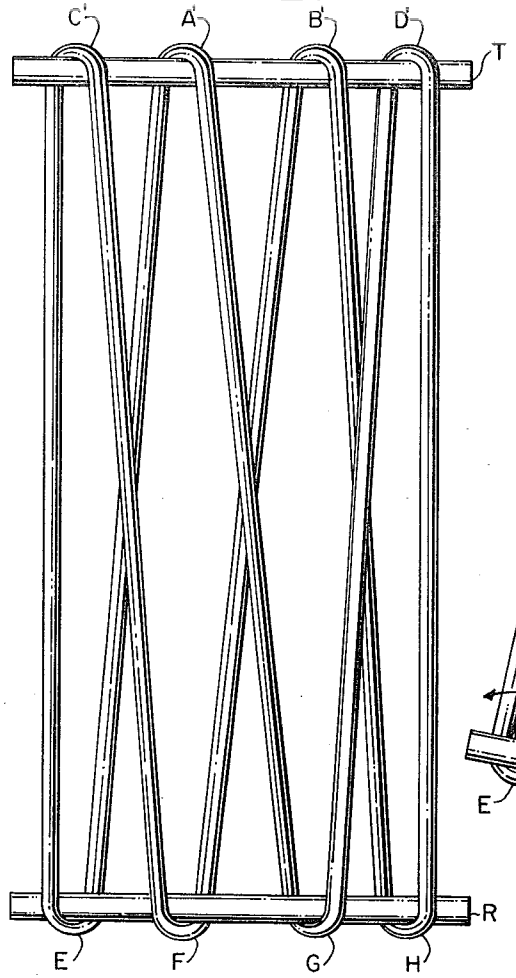
Figure 20:
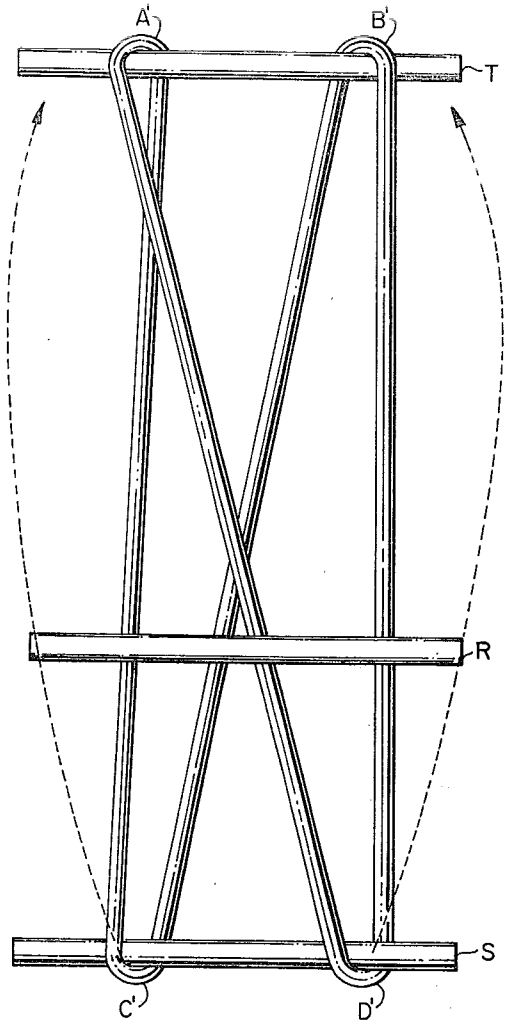
Figure 17:
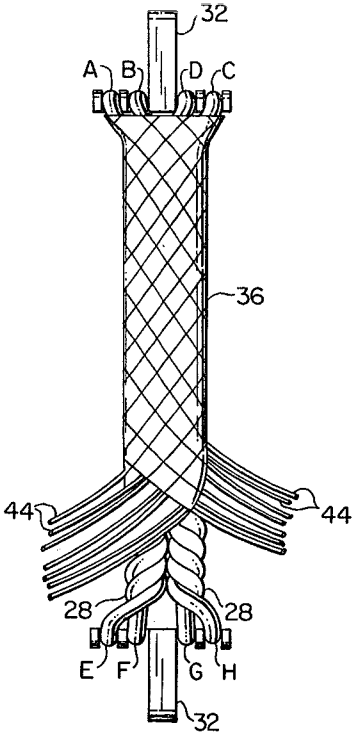
Figure 15:
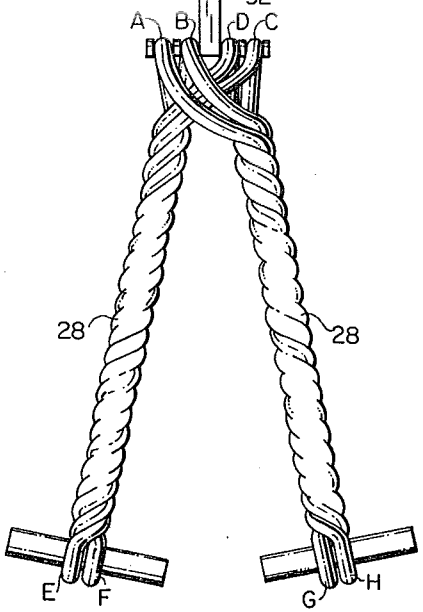

From the configuration of FIG. 13 the cord strands 30, 30 are twisted to form the two ropes 28, 28. This may be done either before or after applying one of the end fittings to the cord. For purposes of discussion however, in the illustrated case and as shown in FIG. 14, one end fitting 32 is applied to the upper end of the cord configuration by placing the upper bends A, B, D and C in the respective thimbles of one end fitting. The cord strands are then divided into two groups of four strands each, as shown in FIG. 14, and each group is separately twisted relative to the upper end fitting 32. This twisting of the two groups of strands is preferably done in opposite directions, as indicated by the arrows of FIG. 14, and causes the two groups of strands to be formed into the two ropes 28, 28 as shown in FIG. 15. Preferably, the twisting of the two strand groups is performed until each of the two ropes 28, 28 exhibits the same stiffness. That is, since the cord 40 itself may be made of fibers twisted in one direction, and possibly because of other factors, the two ropes 28, 28 may have unequal stiffness if twisted the same amount, but equal stiffness may be gained by twisting the two ropes by different amounts. The twisting of the two ropes in opposite direction avoids kinking in the finished sling.

Figure 16:
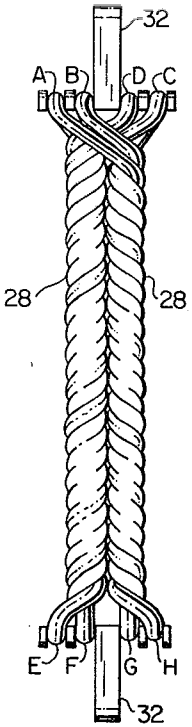

After the ropes 28, 28 are formed, as shown in FIG. 15, the bottom ends E, F, G and H are placed into the respective thimbles of the lower end fitting 32 as shown in FIG. 16. Thereafter, the wrap 36 is formed over the two ropes 28, 28 as by weaving together a plurality of threads 44, 44; and finally the end portions are potted to form the bodies 38, 38 of FIG. 1 and to complete the sling 20.

The fact that the sling 20 is made from a single endless cord 40 has, among other things, the advantage that the length of the sling between its eyes may be accurately controlled. That is, the length of cord needed to produce a sling of desired length can be determined and the starting endless cord then made to this length. However, in the finished sling any error in the length of the starting cord is reduced by a factor of eight due to the cord being formed into eight different strands.

Figure 18:
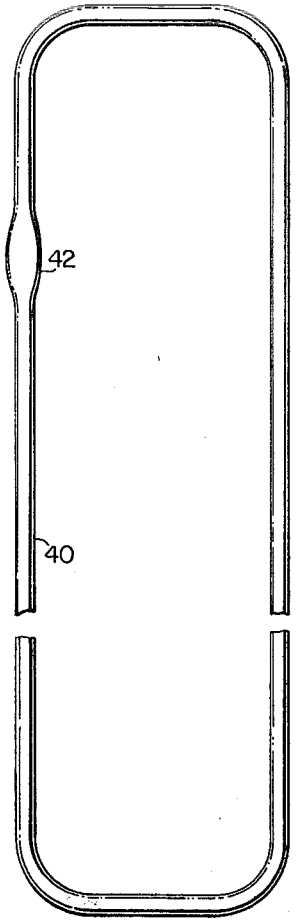

FIGS. 18 to 21 show another sequence of steps for forming and endless cord 40, as shown in FIG. 18, into an eight bended and eight stranded configuration suitable for twisting into two ropes to make a sling.

From FIG. 18 the cord 40 is folded upon itself, as by folding over the bar S, to bring the lower bend next to the upper bend, both of which bends are placed on the bar T. The bar S is then rotated 90° to bring it parallel to the bar T and to bring the cord 40 to the condition shown in FIG. 20. The two lower bends C′ and D′ are then folded over the bar R and hung onto the bar T, as indicated by the dotted arrows, to reach the desired configuration shown in FIG. 21. This configuration may then be formed into a finished sling by subsequently following the steps previously described in connection with FIGS. 14 to 17. In doing this the bends C′, A′, B′ and D′ should be placed on their thimbles 34, 34 of their end fittng 32 in the same order as they appear in FIG. 21.

Figure 22:
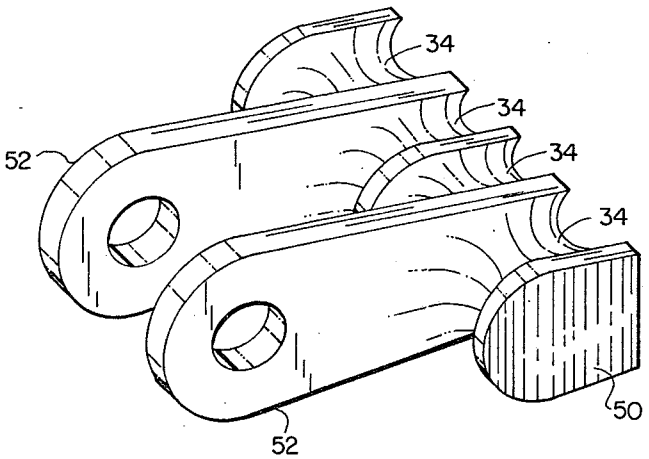
FIG. 22 is a perspective view similar to FIG. 4 showing another form of end fitting.

As mentioned the end fitting of the sling may take various different shapes and forms. In connection with this, it might be noted that although the illustrated end fitting 32 has one apertured ear 26 other end fittings may be used which have two or more spaced ears similar to the ear 26. By way of example, one further such end fitting is shown in FIG. 22, wherein the fitting, indicated at 50, has two apertured ears 52, 52 and four side-by-side thimbles 34, 34 with each each 52 being located between one outboard thimble and the next adjacent thimble. In another two-eared four-thimbled fitting the two ears might also be located outboard of the two outboard thimbles, and in another four-thimbled fitting five ears might be provided by locating two ears outboard of the two outboard thimbles and by locating one ear between each of the three pairs of adjacent thimbles.

I claim:

1. A sling comprising: a cord means extending between two spaced ends and having a plurality of bends at each of said ends and a plurality of strands each extending from one to the other of said ends, half of said strands of said cord means being twisted together to form a first discrete rope extending between said ends and the other half of said strands of said cord means being twisted together to form a second discrete rope extending between said ends, said two ropes being individually distinct and being untwisted relative to one another between said ends, said bends at one of said ends being positioned adjacent one another to form collectively a first eye and said bends at the other of said ends being positioned adjacent one another to form collectively a second eye.

2. A sling as defined in claim 1 further characterized by said cord means consisting of a single endless cord.

3. A sling comprising: a cord means extending between two spaced ends and having a plurality of bends at each of said ends and a plurality of strands each extending from one to the other of said ends, half of said strands of said cord means being twisted together in one direction to form a first discrete rope extending between said ends and the other half of said strands of said cord means being twisted together in the opposite direction to form a second discrete rope extending between said ends, said two ropes being individually distinct and being untwisted relative to one another between said ends, said bends at one of said ends being positioned adjacent one another to form collectively a first eye and said bends at the other of said ends being positioned adjacent one another to form collectively a second eye.

4. A sling as defined in claim 3 further characterized by said cord means consisting of a single endless cord.

5. A sling as defined in claim 1, 2, 3 or 4 further characterized by said two ropes being positioned side-by-side relative to one another between said ends, and a wrap surrounding said ropes to hold them in said side-by-side relationship.

6. A sling as defined in claim 1, 2, 3 or 4 further characterized by said cord means having four bends at each of said ends and eight strands extending between said ends.

7. A sling as defined in claim 1 further characterized by said cord means being made of kevlar.

8. A sling comprising: two end fittings each having a plurality of thimbles and a means for connection to some other part, and an elongated flexible cord means having opposite ends each of which ends is associated with a respective one of said two fittings, said flexible cord means at each of its said ends having a plurality of bends each received in a respective one of said thimbles of the associated one of said end fittings and said flexible cord means also having a plurality of strands each extending from one to the other of said end fittings, half of said strands of said cord means being twisted together to form a first discrete rope extending between said end fittings and the other half of said strands of said cord means being twisted together to form a second discrete rope extending between said end fittings, said two ropes being individually distinct and being untwisted relative to one another between said ends.

9. A sling as defined in claim 8 further characterized by said cord means consisting of a single endless cord.

10. A sling comprising: two end fittings each having a plurality of thimbles and a means for connection to some other part, and an elongated flexible cord means having opposite ends each of which ends is associated with a respective one of said two fittings, said flexible cord means at each of its said ends having a plurality of bends each received in a respective one of said thimbles of the associated one of said end fittings and said flexible cord means also having a plurality of strands each extending from one to the other of said end fittings, half of said strands of said cord means being twisted together in one direction to form a first discrete rope extending between said end fittings and the other half of said strands of said cord means being twisted together in the opposite direction to form a second discrete rope extending between said end fittings, said two ropes being individually distinct and being untwisted relative to one another between said ends.

11. A sling as defined in claim 10 further characterized by said cord means being a single endless cord.

12. A sling as defined in claim 8, 9, 10 and 11 further characterized by said two ropes being positioned side-by-side relative to one another between said ends, and a wrap surrounding said ropes to hold them in said side-by-side relationship.

13. A sling as defined in claim 8, 9, 10 or 11 further characterized by said plurality of thimbles of each end fitting being arranged side-by-side one another along a line perpendicular to the longitudinal axes of said ropes.

14. A sling as defined in claim 8, 9, 10 or 11 further characterized by said means for connection of each of said end fittings being a part of said end fitting which extends beyond its thimbles in the direction away from said cord means and which part is located with half of its associated thimbles on one side of it and with the other half of its associated thimbles on the other side of it.

15. A sling as defined in claim 8, 9, 10 or 11 further characterized by each of said end fittings having four thimbles and said flexible cord means correspondingly having eight bends and eight strands with each of said two ropes consisting of four of said strands.

16. A sling as defined in claim 8, 9, 10 or 11 further characterized by said cord means being made of kevlar.

17. A sling as defined in claim 12 further characterized by each of said end fittings having at least a substantial portion of itself embedded in a body of potting material along with the portions of said two ropes and of said wrap immediately adjacent such end fitting.

18. A sling as defined in claim 17 further characterized by each of said end fittings having its means for connection to some other part extending beyond the associated body of potting material.

19. A method for making a sling which method comprises the steps of: providing a cord means, arranging said cord means to provide an elongated configuration having a plurality of bends at each end of the configuration and a plurality of strands each extending between said ends of the configuration, dividing said strands into first and second groups each having the same number of strands, holding said bends at one end of said configuration and collectively rotating the bends of said first group of strands at the other end of said configuration to twist said strands of said first group to form a first discrete rope, holding said bends at said one end of said configuration and collectively rotating the bends of said second group of strands at the other end of said configuration to twist said strands of said second group to form a second discrete rope individually distinct from and untwisted relative to said first rope, arranging said bends at one end of said configuration adjacent one another to form one eye, and arranging said bends at the opposite end of said configuration adjacent one another to form a second eye.

20. A method for making a sling as defined in claim 19 further characterized by providing said cord means in the form of a single endless cord.

21. A method for making a sling which method comprises the steps of: providing a cord means, arranging said cord means to provide an elongated configuration having a plurality of bends at each end of the configuration and a plurality of strands each extending between said ends of the configuration, dividing said strands into first and second groups each having the same number of strands, holding said bends at one end of said configuration and collectively rotating the bends of said first group of strands at the other end of said configuration in one direction to twist said strands of said first group to form a first discrete rope, holding said bends at said one end of said configuration and collectively rotating the bends of said second group of strands at the other end of said configuration in the opposite direction to twist said strands of said second group to form a second discrete rope individually distinct from and untwisted relative to said first rope, arranging said bends at one end of said configuration adjacent one another to form one eye, and arranging said bends at the opposite end of said configuration adjacent one another to form a second eye.

22. A method for making a sling as defined in claim 21 further characterized by providing said cord means in the form of a single endless cord.

23. A method for making a sling as defined in claim 21 further characterized by arranging said two ropes in side-by-side relationship, and applying a wrap around said two ropes to hold them in said side-by-side relationship.

24. A method for making a sling which method comprises the steps of: providing a cord means, arranging said cold means to provide an elongated configuration having a plurality of bends at each of the configuration and a plurality of strands extending between said ends of the configuration, dividing said strands into two groups each having the same number of strands, twisting one of said groups of strands in one direction to form one discrete rope, twisting the other of said groups of strands in the other direction to form a second discrete rope individually distinct from and untwisted relative to said first rope, providing two end fittings each having a plurality of side-by-side thimbles, at some stage in said method attaching one of said end fittings to one end of said cord means by placing the bends at that end of the configuration into respective thimbles of said one end fitting, and following the formation of said two discrete ropes attaching the other end fitting to the other end of said configuration by placing the bends at that end of the configuration into respective thimbles of said other end fitting, arranging said two ropes in side-by-side relationship, and applying a wrap around said two ropes to hold them in said side-by-side relationship.

25. The method for making a sling as defined in claim 24 further characterized by potting at least a substantial portion of each of said end fittings and the immediately adjacent portions of said two ropes and of said wrap in a body of potting material.

26. A method for making a sling which method comprises the steps of: providing a single endless cord, folding said cord upon itself to provide an elongated configuration having four bends at each end of the configuration and eight strands extending between said ends of the configuration, providing two end fittings each having four side-by-side thimbles, attaching one of said end fittings to one end of said configuration by placing the four bends at that end of the configuration into respective thimbles of said end fitting, dividing said eight strands into two groups of four strands each, twisting one of said groups of strands in one direction to form one discrete rope, twisting the other of said groups of strands in the other direction to form a second discrete rope individually distinct from and untwisted relative to said first rope, after the twisting of said two groups of strands attaching the other of said end fittings to the other end of said configuration by placing the four bends at said other end of the configuration into respective thimbles of said other end fitting.

27. The method for making a sling as defined in claim 26 further characterized by arranging said two ropes in side-by-side relationship, and applying a wrap around said two ropes to hold them in said side-by-side relationship.

28. The method for making a sling as defined in claim 27 further characterized by potting at least a substantial portion of each of said end fittings and the immediately adjacent portions of said two ropes and of said wrap in a body of potting material.

* * * * *